United States Patent [19]

Ferguson et al.

[11] 3,952,684

[45] Apr. 27, 1976

[54] ADJUSTABLE MOORING SYSTEM

[75] Inventors: Hobart D. Ferguson, Richardson; George W. Morgan, Dallas, both of Tex.

[73] Assignee: Sun Oil Company (Delaware), Dallas, Tex.

[22] Filed: May 21, 1974

[21] Appl. No.: 472,032

[52] U.S. Cl. ..... 114/230; 114/.5 D; 254/190 R

[51] Int. Cl.[2] ..... B63B 21/50

[58] Field of Search ..... 114/230, .5 D, .5 R, 114/.5 T, 206 R, 235 R, 210; 61/46.5; 175/7; 115/7, 8; 254/190 R, 144, 148, 175.3

[56] References Cited

UNITED STATES PATENTS

| | | | |
|---|---|---|---|
| 969,873 | 9/1910 | Isaac | 115/7 |
| 2,986,889 | 6/1961 | Ludwig | 61/46.5 |
| 3,035,535 | 5/1962 | Billups | 114/230 |
| 3,112,097 | 11/1963 | Taylor | 254/190 R |
| 3,221,667 | 12/1965 | Watt | 254/190 R |
| 3,242,894 | 3/1966 | Anderson | 114/210 |
| 3,461,828 | 8/1969 | Bielstein | 114/230 |
| 3,474,749 | 10/1969 | Williamson | 114/230 |
| 3,708,152 | 1/1973 | Bulin | 254/190 R |
| 3,780,685 | 12/1973 | Horton | 114/.5 D |
| 3,822,663 | 7/1974 | Boschen | 114/.5 D |

FOREIGN PATENTS OR APPLICATIONS

| | | | |
|---|---|---|---|
| 1,231,036 | 4/1960 | France | 114/.5 T |

*Primary Examiner*—Trygve M. Blix
*Assistant Examiner*—Charles E. Frankfort
*Attorney, Agent, or Firm*—Donald R. Johnson; Macka L. Murrah

[57] ABSTRACT

Buoyant bodies such as those used for drilling oil and gas wells in water-covered areas are moored to the floor of the body of water with lines in the catenary configuration. Rotational motions induced by such configurations are reduced by providing for vertical adjustment in the point of attachment of the lines on the buoyant body.

2 Claims, 5 Drawing Figures

ADJUSTABLE MOORING SYSTEM

BACKGROUND OF THE INVENTION

The invention relates to mooring buoyant bodies, and more particularly to mooring said bodies to remove instabilities inherent in flotation.

There are many activities now being conducted in watercovered areas of the earth's surface. These areas include lakes, oceans, seas, rivers or other bodies of water, the terms for which can be used interchangeably for purposes of the invention. In the petroleum industry, for example, the search for new sources of oil and gas has been extended particularly to the world's oceans. The oceans and other bodies of water present numerous problems to such activities, the primary one of which is to develop buoyant bodies such as platforms as bases of operations. Due to wave action of the oceans, platform stability can be an important factor in some activities such as drilling oil and gas wells, in which movement of a drilling platform can bend or break drill pipes.

A number of types of offshore drilling platforms have been proposed. These include platforms supported by columns having their lower ends resting upon the ocean floor (U.S. Pat. No. 2,248,051 by Armstrong); floating elevated platforms supported by columns from a floating pontoon (U.S. Pat. Nos. 3,011,467 by Le Tourneau and 3,163,147 by Collipp); a permanent floating platform employing counterweights for adjustment to vertical oscillations and reduction of roll (U.S. Pat. No. 3,294,051 by Khelstovsky); and floating platforms provided with anchors with parallel anchor lines, which are also known as semi-submersible platforms and tension leg platforms (U.S. Pat. Nos. 2,399,611 by Armstrong, 3,154,039 by Knapp and 3,540,396 by Horton).

The prior platforms having columns resting on the ocean floor are stable but are limited to relatively shallow water, due to the expense involved in building tall support columns. This and related costs such as maintenance make such platforms uneconomical at water depths greater than 350 to 400 feet. The floating platforms are much less expensive than the columnar type, but they are subject to influence by wave action and are thus much more unstable. This is particularly true of the unanchored platforms but is nevertheless present to an undersirable degree in both the anchored and unanchored types disclosed by the prior art.

The platforms disclosed in Armstrong, Knapp and Horton are anchored, or moored, with cables in a parallelogram geometry in which all the cables extend parallel to each other to the ocean floor. The parallelogram geometry essentially eliminates rotational motions about axes in the plane of the platforms' horizontal surface. These rotational motions are of two types: pitch, which is rotation about an axis normal to the direction of ocean currents; and roll, which is rotation about an axis in the direction of the ocean currents. The parallelogram geometry does not, however, eliminate lateral, or translational motions of the platform. These translational motions include surge, which is movement in the direction of current flow, and sway, which is movement normal to the direction of current flow.

A second conventional geometry for mooring lines is catenary in which the platform is moored with cables anchored laterally from the normal parallelogram anchor positions. The catenary geometry is helpful in eliminating horizontal excursions of platform, but it inherently introduces rotational motions.

A combination of the two mooring gemoetries can be used to provide some of the advantages of both. The parallelogram geometry provides the primary restraint while the catenary provides the secondary. However, the catenary mooring is limited in the amount of restraint that it can provide without introducing rotational motions. Under extreme conditions the restraint can be so great as to cause the adjacent cable in the parallelogram configuration, known as a tension leg, to go slack and cause the platform to pitch or roll.

An object of the invention, therefore, is to provide improved means for eliminating rotational and translational motions from floating platforms or other bodies.

SUMMARY OF THE INVENTION

The invention embodies a system which stabilizes a buoyant body by mooring it with lines in at least a catenary configuration and vertically adjusting the attachment point of the lines on the buoyant body.

BRIEF DESCRIPTION OF THE DRAWINGS

The invention may be more fully understood by considering the exemplary embodiments illustrated in the following drawings.

DESCRIPTION OF THE PREFERRED EMBODIMENTS

Figure 1:
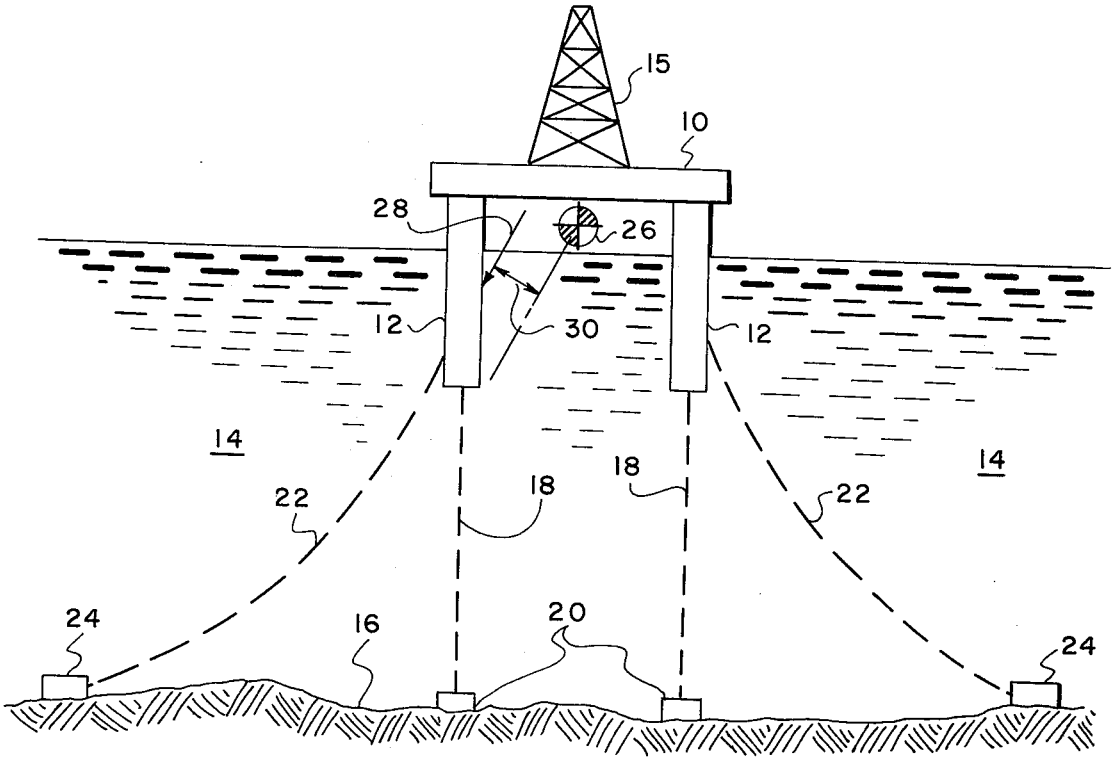
FIG. 1 is a schematic representation of a buoyant body moored using both parallelogram and catenary configurations.

The invention may be used with the mooring configuration shown in FIG. 1. A platform 10 having legs 12 floats in a body of water 14. A derrick 15 sits atop platform 10. The platform can be moored to the ocean floor 16 by means of two sets of cables. A first set of cables 18 are attached to legs 12 of platform 10 and extend downwardly parallel to each other to floor 16 where they are attached to anchors 20. This is the parallelogram configuration. A second set of mooring lines 22, such as cables or chains, attached to legs 12 extend downwardly and outwardly and are tied to anchors 24 on floor 16. This is the catenary configuration. Only two cables in each set are shown in the view of FIG. 1, but a number of cables may be attached around the periphery of platform 10.

The rotational effect of catenary mooring is shown by means of the center of gravity 26 of platform 10 and force vector 28 resulting from restraint offered by cable 22. Since the force vector does not point in the direction of the center of gravity of the platform, a moment arm illustrated by arrows 30 is formed. The effect in the situation illustrated is a counterclockwise rotation about the center of gravity 26.

Figure 2:
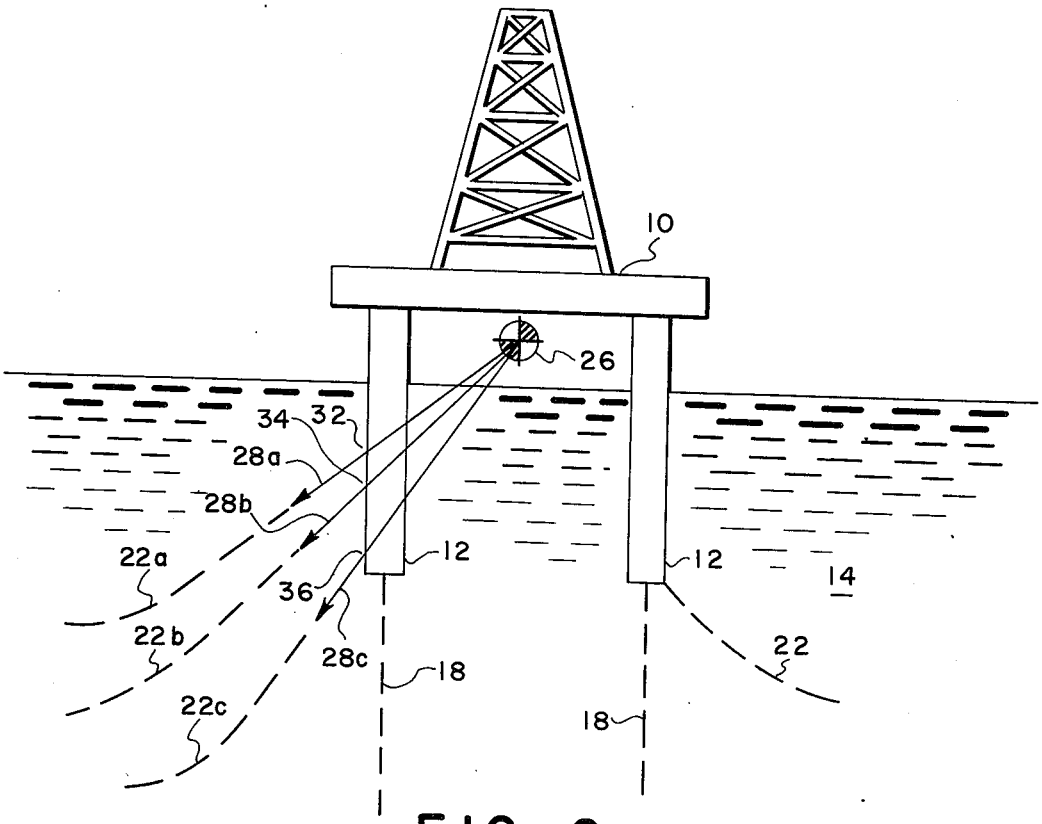
FIG. 2 is a schematic representation of restraint forces imposed upon the buoyant body of the catenary cables.

The manner in which the invention reduces rotation of the platform is illustrated in FIG. 2. Cable 22 is shown connected to leg 12 of platform 10 at three exemplary positions. In the first position, the cable, which is designated as 22*a* is connected at attachment point 32. In the second position the cable 22*b* is connected at point 34, and in the third position, cable 22*c* is connected at point 36. Each attachment point represents the optimum position for reducing the moment arm about the center of gravity 26 for each condition of mooring restraint provided by a cable 22. In each case the attachment point may be chosen such that the force vector provided by the mooring restraint for each condition, points in the direction of the center of gravity 26. The vector is designated 28*a* for cable 22*a*, 28*b* for cable 22*b* and 28*c* for cable 22*c*. The moment arm produced by the vector may thus be reduced or eliminated by providing a vertically adjustable attachment point on the platform so that the mooring configuration can be altered to suit wave and current conditions of the water as well as the topography of the floor to which the platform is anchored.

Figure 3:
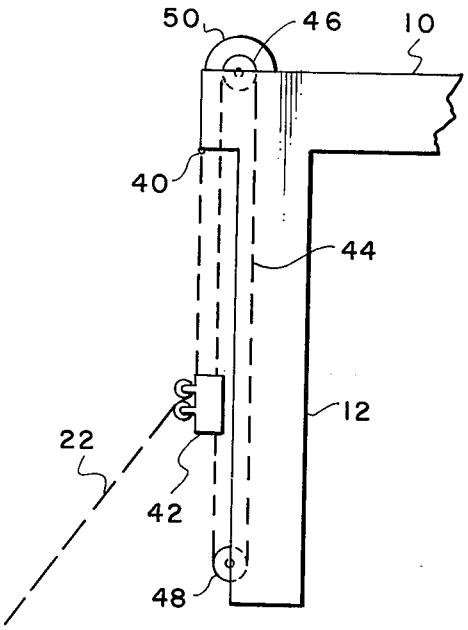
FIG. 3 is a partial view of a buoyant platform which illustrates one means for vertically adjusting the attachment point of a mooring line.

One type of mechanism for adjusting the mooring attachment point is shown in FIG. 3. A portion of platform 10 and one of its legs 12 is shown. Cable 22 threads through a block 42 and is connected to platform 10 at point 40. Block 42 is attached to a continuous chain 44, or the like, which is looped about a sheave 46 attached to the top of platform 10 and a sheave 48 attached to the bottom of the platform leg 12. Chain 44 is movable, and thus block 42 is vertically adjustable by means of a motor and gear mechanism 50, or the like. By adjusting the vertical position of block 42, the effective attachment point of cable 22 can thus be varied.

Figure 4:
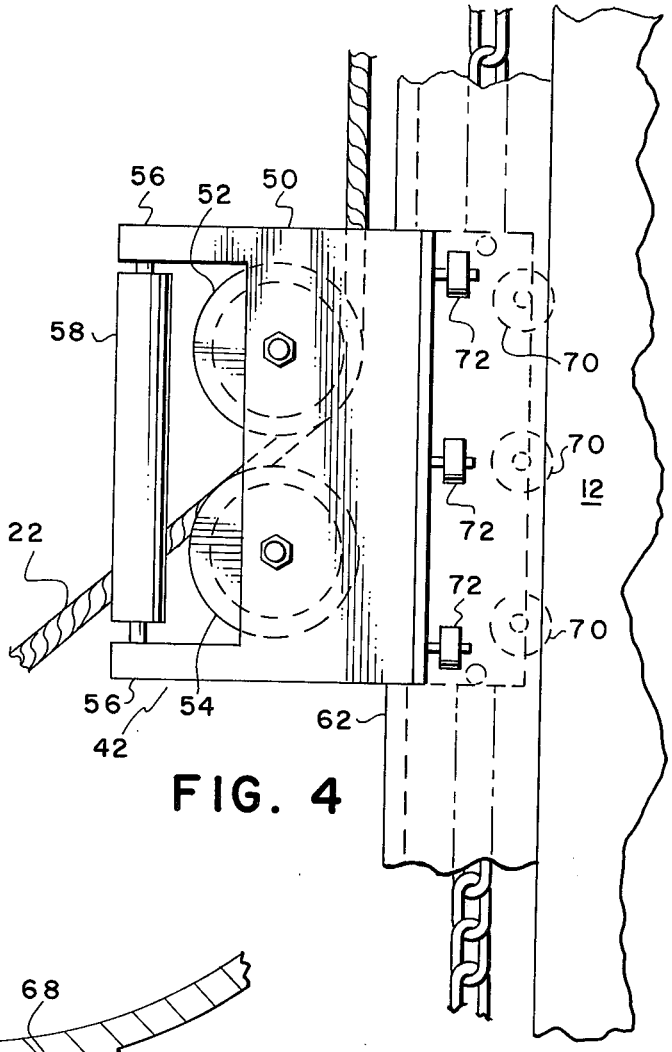
FIG. 4 is a more detailed side view of the adjustment apparatus of FIG. 3.
Figure 5:
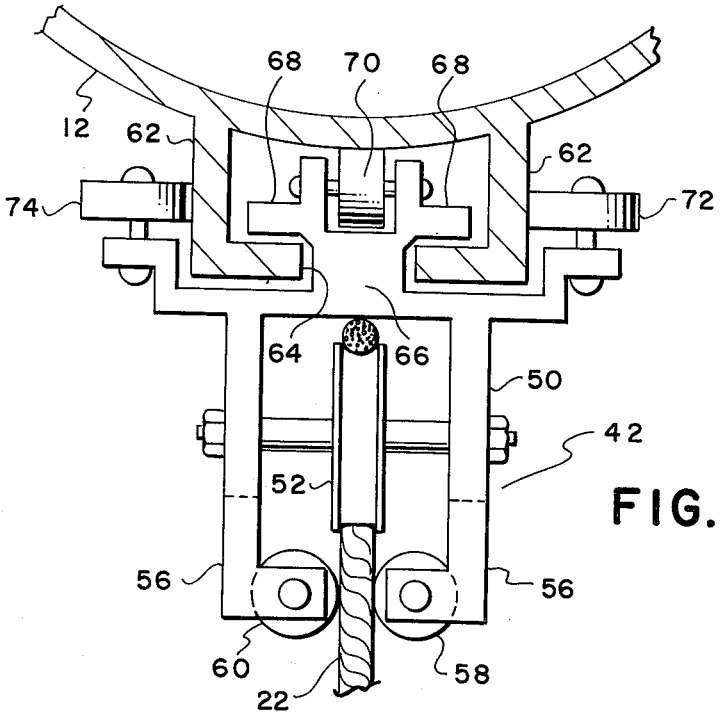
FIG. 5 is a top view of the apparatus of FIG. 4.

Block 42 and associated apparatus is shown in more detail in FIGS. 4 and 5. Block 42 includes a framework 50 having connected therein sheaves 52 and 54, one above the other. Projecting in front of the two sheaves by means of arms 56 are two vertically-disposed rollers 58 and 60. Cable 22 threads between the rollers 58 and 60 and around sheaves 52 and 54. The rollers 58 and 60, which together are known as a fairlead, prevent cable 22 from being pulled to the side and from the sheave track. Block 42 is secured to leg 12 of the platform by means of a double flange 62 having a center slot 64. A small neck 66 of framework 50 extends through slot 64. Neck 66 has flanges 68, which are wider than slot 64, inside double flange 62 to prevent movement of block 42 away from leg 12. Also attached to neck 66 are rollers 70 in a vertical line and in contact with leg 12. In addition, two other sets of rollers 72 and 74 are attached to framework 50 in a vertical line and arranged to roll along the lateral surfaces of double flange 62. The rollers facilitate movement of framework 50 through double flange 62. There are no rollers or bearings between flanges 68 and the front portion of double flange 62 since the combination of the outward restraint force provided by cable 22 and friction between the aforementioned flanges provides assistance in maintaining block 42 in a selected vertical position.

While particular embodiments of the invention have been shown and described, it is apparent that changes and modifications may be made without departing from the spirit and scope of the invention. It is the intention of the appended claims to cover all such changes and modifications.

What is claimed is:

1. System for mooring a floating platform to the floor of a body of water, comprising: first anchors on the floor at a plurality of locations about the platform and laterally displaced therefrom; attachment devices vertically positionable relative to said platform and positioned about the periphery of the platform, said devices corresponding in number to the first anchors; first mooring lines connected between the first anchors and the attachment devices in a catenary configuration; second mooring lines connected to the platform about its periphery and extending downwardly to the floor in a parallelogram configuration; and anchors, corresponding in number to the second mooring lines, on the floor and connected to said second mooring lines.

2. A system for mooring a buoyant body to the floor of a body of water, comprising: a plurality of mooring lines connected between the buoyant body and the floor in a catenary configuration, said connection to the buoyant body being vertically adjustable relative to said body; and a plurality of mooring lines connected between the buoyant body and the floor in a parallelogram configuration.

* * * * *